US005155474A

United States Patent [19]

Park et al.

[11] Patent Number: 5,155,474

[45] Date of Patent: Oct. 13, 1992

[54] PHOTOGRAPHIC SECURITY SYSTEM

[75] Inventors: Roy G. Park; Bud R. Park, both of William Lake, Canada

[73] Assignee: Park Photo Protection System Ltd., Toronto, Canada

[21] Appl. No.: 723,053

[22] Filed: Jun. 28, 1991

[51] Int. Cl.[5] ..... G08B 13/18

[52] U.S. Cl. ..... 340/691; 340/541; 340/567; 340/693; 354/75; 354/76

[58] Field of Search ..... 340/691, 693, 567, 541; 354/75, 76; 346/107 R; 358/108

[56] References Cited

U.S. PATENT DOCUMENTS

| | | | |
|---|---|---|---|
| 943,232 | 12/1909 | Ashe | 340/541 |
| 3,349,679 | 10/1967 | Lohman, III | 354/75 |
| 3,634,846 | 1/1972 | Fogiel | 340/666 |
| 4,063,251 | 12/1977 | Harsnett | 354/75 |
| 4,088,986 | 5/1978 | Boucher | 340/693 |
| 4,347,590 | 8/1982 | Heger et al. | 340/691 |
| 4,510,488 | 4/1985 | St. Jean et al. | 340/567 |
| 4,651,144 | 3/1987 | Pagano | 340/693 |
| 5,027,104 | 6/1991 | Reid | 340/541 |

*Primary Examiner*—Glen R. Swann, III
*Attorney, Agent, or Firm*—Ridout & Maybee

[57] ABSTRACT

An intrusion detection apparatus for detecting the presence of an intruder in a forbidden space comprises a sensor, an illumination system, a sound system and a still camera. When the sensor detects the presence of an intruder, it switches on the illumination system and the sound system (e.g. a buzzer or an alarm), and activates the still camera to take a picture of the illuminated intruder. The sound system masks the operation of the camera so that the intruder is unaware that a picture has been taken.

13 Claims, 3 Drawing Sheets

PHOTOGRAPHIC SECURITY SYSTEM

FIELD OF THE INVENTION

This invention relates to intrusion detection devices such as burglar alarms, and more particularly to intrusion detection devices which create a visible record of the intruder.

BACKGROUND OF THE INVENTION

It is known and commonplace to provide video camera surveillance of commercial and financial premises such as stores and banks, both during closed hours and open hours. Untoward happenings in the premises, such as robberies or burglaries, are thereby recorded to facilitate subsequent crime detection. However, such arrangements are normally too expensive for installation and use on a domestic scale. Moreover, their presence is normally well known and so easily recognized that an intruder after hours can normally locate and disable them as a preliminary to the commission of a crime.

Intrusion alarm systems available for the domestic market normally involve the activation of an audible alarm or, during operation after dark, the activation of a light system. They are commonly operated in response to infra red sensors, which detect the presence of an intruder by heat sensing. Such arrangements are commonly connected to police stations by automatic telephone hook-up, so that any triggering of the system automatically alerts the local police. Unless such systems are very carefully arranged and armed, however, there is a significant risk of false alarms by their detection of authorized bodies moving around the house after dark, movement of domestic animals etc. Moreover, such arrangements are of little use unless there is the capability of a fast response to their actuation, on the part of residents or local police. Otherwise, they depend upon the effectiveness of their deterrent value on the intruder, e.g. when lights or audible alarms are activated. Such arrangements are of little value in protecting remote premises such as country cottages which may be left unattended for substantial periods of time, and which are too far from any local security station to allow a reasonable possibility of interception and apprehension of the intruder.

BRIEF REFERENCE TO THE PRIOR ART

U.S. Pat. No. 3,634,486 Fogiel, describes a burglary and fire detection system in which sensors detect an intrusion into the space to be protected and transmit signals to logical circuitry. The sensors proposed in this patent are photoelectric sensors, pressure sensors activated when an intruder steps onto them, heat detection sensors, smoke detectors, or vibration sensors. The signals from the sensors are processed by logical control circuitry to create an alarm condition such as a siren, a horn, bells, flashing lights, steady lights, flood lights, audio recordings, television recordings, a photographic camera, or an appropriate signal in a local police station.

U.S. Pat. No. 3,349,679 Lhoman, shows a door actuated camera provided in a taxi cab, for photographing the passenger. This is not, however, a system which is automatically triggered by an unauthorized intruder.

It is an object of the present invention to provide a novel intrusion detection system which is sufficiently economical that it can be installed and used with domestic premises.

SUMMARY OF THE INVENTION

The present invention provides an intrusion detection system which includes a photographic still camera which is automatically triggered to take a still photograph of an unauthorized intruder, for use in subsequent identification of the intruder. The system according to the invention includes a sensor which detects the presence of the intruder, and which automatically illuminates the intruder sufficiently to allow a still photograph to be taken. The system is arranged so that the intruder remains unaware that a photograph has been taken. This is accomplished by arranging for the sensor to trigger both the illumination means providing adequate light for the taking of the photograph, and for deterrence purposes, and an audible signal effectively to mask the sound of the camera operation. The combination of the sudden illumination and the onset of the audible signal is sufficient to convince the intruder that a conventional light and sound signal intrusion detector has been encountered leaving the intruder unaware of the presence of the camera, so that he does not attempt to remove or smash it.

Thus, according to the present invention, there is provided an intrusion detection apparatus adapted for sensing movement of a body in a space, comprising:

a sensor adapted to sense a body in the space;

light means adapted to illuminate the body in response to the sensing thereof by the sensor;

a photographic still camera adapted to be triggered to photograph the body during its illumination by the light means;

and a sound generator adapted to be actuated by the sensor to emit sound which disguises or overrides the sound of the camera operation.

BRIEF REFERENCE TO THE DRAWINGS

FIG. 1 of the accompanying drawings diagrammatically illustrates the sensor and lights arrangement, and the camera, as it would appear in practice, wall mounted to face an access point into premises;

FIG. 2 diagrammatically illustrates the components of the system shown in FIG. 1, i.e. the apparatus with the front covers removed;

In the drawings, like numerals indicate like parts.

DESCRIPTION OF THE PREFERRED EMBODIMENTS

Figure 1:
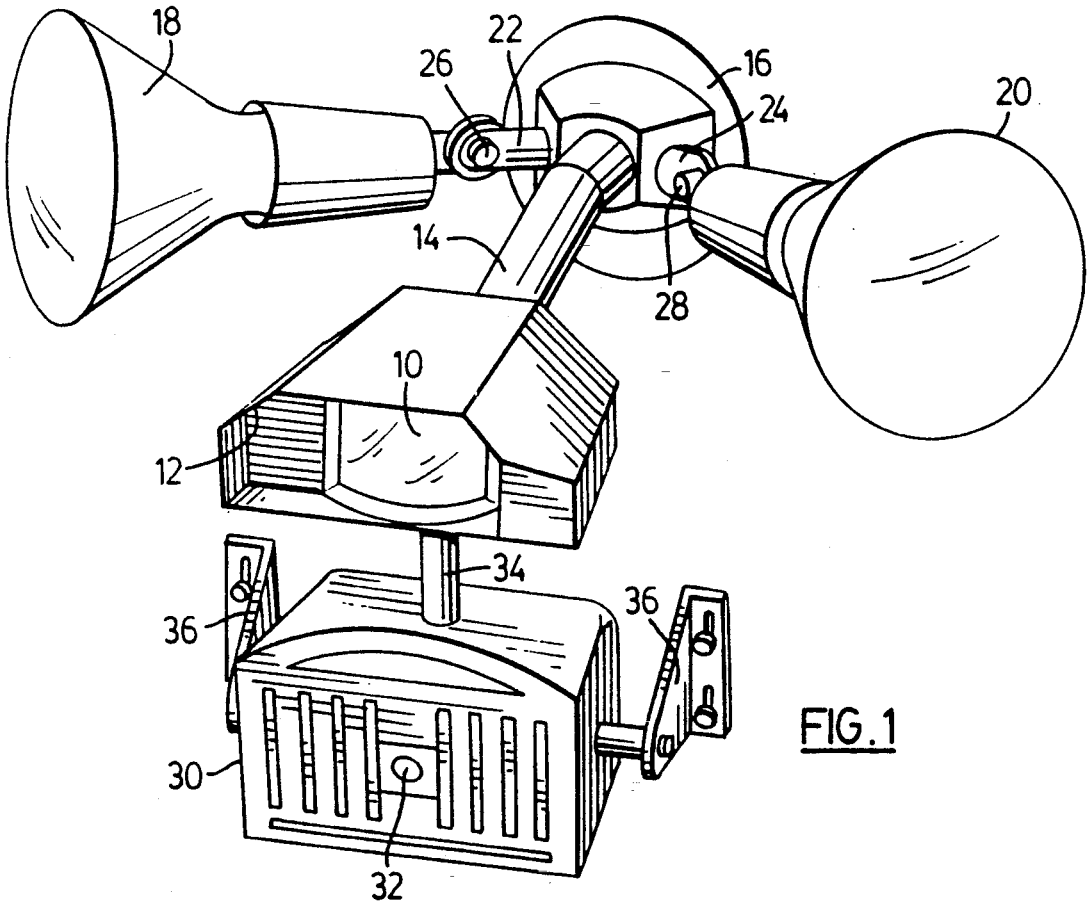

Preferably, the sensor is an infra red sensor. This is a form of intrusion sensor commonly and cheaply available on the market, which detects the presence of a body due to heat changes. It is mounted so that it is directed towards an opening such as a doorway or window through which an unauthorized intruder might be expected to attempt to gain entry. The preferred embodiment of the invention also includes an electronic logic board controlling the operation of the camera, light means and sound generator in response to signals received from the infra red sensor.

It is necessary, according to the present invention, to illuminate the intruder ready for photography, and to disguise the sound of the operation of the camera. Accordingly, the logic board is set to control the sequence of operations such that the camera is triggered during operation of the light means and the sound generator. The operation of these two items may be enough in itself to deter the intruder from further entry. However, even if this should be the effect, the camera is triggered very quickly during operation of the light means and sound generator so that a photograph of the intruder is obtained in any event. The deterrent effect of the combination of light and sound may be sufficient to prevent further entry by the intruder in premises located in urban, crowded areas, but may not be sufficient to deter further entry into remotely located premises such as country cottages, so that the obtaining of a still photograph of the intruder is even more valuable in such situations.

Other features may be associated with the intrusion detection device of the preferred embodiment of the present invention, for example an automatic telephone dialler, also under the control of the logic board. Such a dialler can be arranged so that the local police station is automatically alarmed when the device is triggered by an intruder. Such an automatic telephone dialler can also be arranged in a unit disposed in a remote country cottage, promptly to alert the owner at a remote location that his cottage has been subjected to unauthorized entry.

Preferably also, the camera included in the preferred embodiment of the invention is visually disguised as further protection against the intruder's knowing that he has been photographed. For this purpose, the camera may be concealed in a housing which resembles some other common, small domestic appliance, such as a doorbell chime box, a radio, a smoke detector, a wall mounted picture, a fuse box etc. Provided that the lens remains substantially unobstructed, and the focus and other operation of the camera is free from interference, the form of disguise of the camera is unimportant.

Another feature of the preferred embodiment of the invention is a time and date recording means associated with the camera, which automatically prints onto the photograph, after development thereof, the time and date upon which the photograph was taken. Such features are commonly available on standard, readily available cameras. They provide an additional, valuable aid in subsequent detection and identification of the unauthorized intruder. Preferably also, the camera is of the automatic wind-on and re-wind type.

It is preferred that the light means and sound generator be actuated to persist for a period of at least five minutes and preferably fifteen minutes, so as to ensure that they most closely resemble light and sound burglar alarm systems currently available on the market. This adds to the disguise of the camera operation. A sudden flash of light is to be avoided, since this would suggest to the intruder that flash photography had been undertaken, and cause the intruder to attempt to locate and perhaps to smash the camera itself. The apparatus according to the invention preferably includes a battery pack for energizing the sensor, the light means, the camera trigger, and the sound generator, under control of the logic board. Most preferably, the battery pack is a rechargeable battery pack, such as a nickel-cadmium battery, and is accompanied by a trickle charger, connected to a mains outlet to ensure that the battery pack is kept in a charged, operable condition. This is particularly useful where the device is to be used in a remote country cottage, which may remain unattended for several months at a time.

Another preferred feature is the inclusion of a visual indicator to show that, since last inspection, the apparatus has been triggered, so that the camera film needs to be removed and developed. This can take the form of a light emitting diode, connected to the logic board, and visible through the housing containing the camera. In addition, a second visual indicator may be included of similar form, to indicate that the device is armed and ready for activation.

SPECIFIC DESCRIPTION OF THE MOST PREFERRED EMBODIMENT

FIG. 1 of the accompanying 7 drawings diagrammatically illustrates an IR sensor 10 mounted in a housing 12 and adjustably connected via arm 14 to a wall mounted plate 16. A pair of halogen lamps 18, 20 constituting an illumination means are also mechanically connected to the wall plate 16. The mechanical connections are by way of respective arms 22, 24 and ball joints 26, 28. Thus, the lamps 18, 20 and the sensor 10 can be adjusted after wall mounting, to illuminate and survey appropriate areas.

A suitable arrangement of IR sensor and lamps is that available on the Canadian market under the name "Beytwin House Security Infrared Motion Sensor and Outdoor Light Control", Model 812/813/814. This device can be rewired as described below so as to feed the signals from the sensor to a logic control board and thence to the lamps, and also to a sound generator and camera trigger mechanism in accordance with the invention.

Mounted on the wall below the sensor housing 12 is a camera housing 30, through an aperture in the front of which the camera lens 32 is visible. The camera housing 30 is arranged to hide the rest of the camera and to disguise it, for example, as a doorbell chime box. Housing 30 is connected to sensor 10 by appropriate electrical connectors 34. Housing 30 is mounted to the wall by means of a pair of brackets 36 permitting angular and height adjustment of housing 30 and the camera therein.

Figure 2:
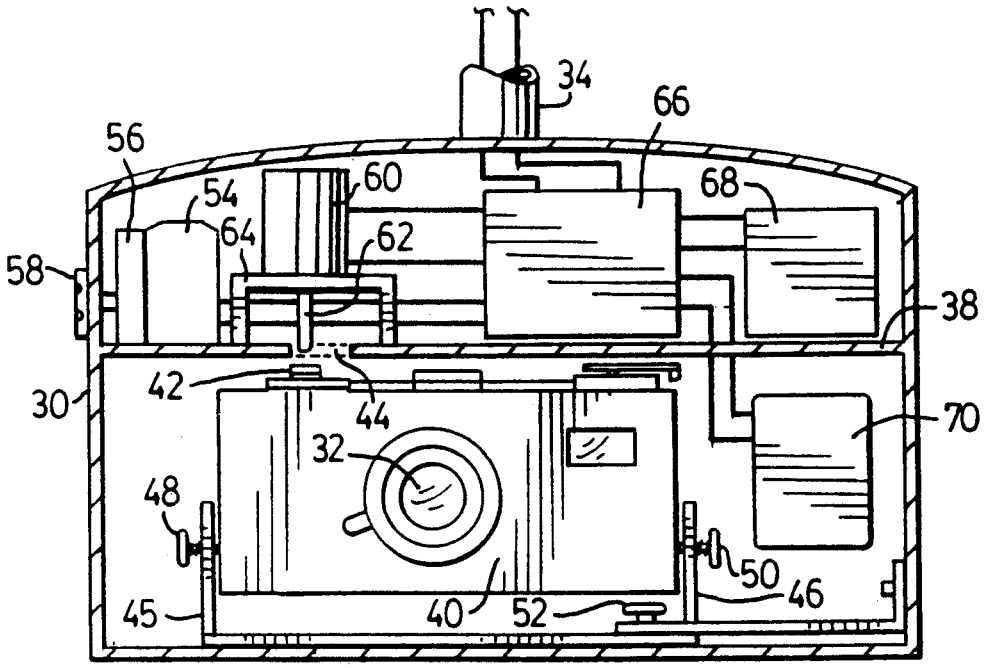

FIG. 2 of the accompanying drawings illustrates the contents of the camera housing 30. A horizontal shelf 38 divides the interior into upper and lower portions. The camera 40, of the automatic wind-on, rewind and date and time display type, is mounted in the lower portion with its shutter operator 42 disposed directly below a slot 44 in the shelf 38. On the bottom on the housing 30 there is provided a 2-part slide, each part having a respective upstanding bracket 45, 46 with respective screw clamps 48, 50 to hold the camera 40 therebetween. Thus, the height of the camera within the housing 30 is adjustable, to assure registry of the lens 32 with an appropriate aperture in the front of the housing 30. The parts of the two part slide are adjustably secured together by a clamping nut 52 in one part, extending through an elongated slot in the other part. Thus, the lateral position of the camera 40 within the housing 30 can be adjusted, and the separation of brackets 45 and 46 can be varied to accommodate different sizes of camera. The space to the sides and bottom of the camera 40 within the housing 30 may be filled with foam rubber or plastic, to provide more accurate positioning and minor adjustment of the camera 40.

On the top of the shelf 38 within the housing 30 are mounted a rechargeable battery pack 54 and trickle charger 56, connected through the side wall of the housing to a mains plug 58. A solenoid 60 and associated plunger 62 are mounted on a bracket 64 on the shelf 38, with the end of the plunger 62 directly above the camera shutter operator 42. Also mounted on the shelf 38 in the upper portion of the housing 30 is a logic control board 66 and a sound generator 68, namely an electrically operated buzzer of the type normally used in domestic smoke detectors. In the lower portion of the housing 30 is mounted an automatic telephone dialler 70. The logic control board 66, solenoid 60, battery pack 54, sound generator 68 and dialler 70 are all suitably electrically connected for operation as described below.

Figure 3:
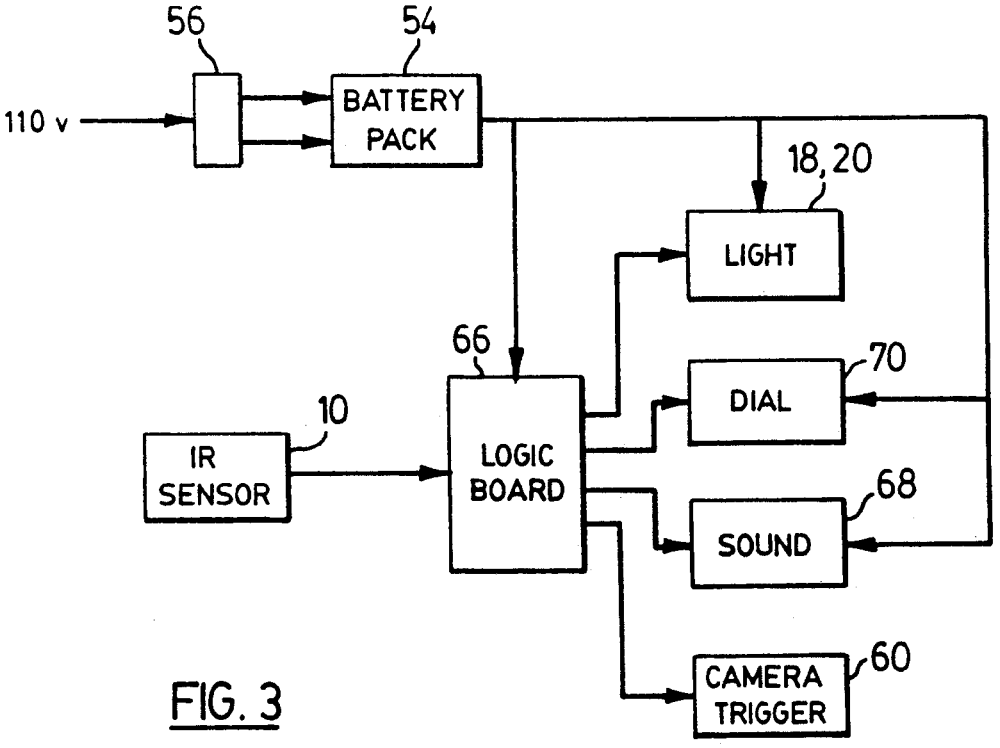
FIG. 3 is a block diagram of the component parts of the system as a whole.

The interconnection of the parts for operational purposes is generally illustrated in FIG. 3. Power is supplied to the logic board 66, the lights 18, 20, the dialler 70, the sound generator 68 and the solenoid 60 from the battery pack 54, under control of the logic control board 66. The IR sensor 10 feeds a signal, on detecting a moving body in its field of surveillance, into the logic board 66. This signal is processed by the logic board 66 firstly to switch on the lamps 18, 20 to illuminate the subject to be photographed, and secondly but almost instantaneously thereafter, to activate the noise generator 68 and the automatic telephone dialler 70. The logic board 66 energizes the solenoid 60, whilst the lights and sound generator are operating, to depress its plunger 62 and trigger the camera 40 to photograph the illuminated subject, at the time of maximum surprise and confusion of the subject caused by the lights and the sound generator. The lights 18, 20 are arranged to stay on for about 5 minutes, and then to switch off. The sound generator is arranged to stay on for about the same length of time, or at least long enough to be sure to cover the camera actuation and automatic wind-on or re-wind. The solenoid action to depress plunger 62 is substantially instantaneous. After one minute from its actuation, should the IR sensor detect further movement on the part of an intruder, the sound generator 68 and the solenoid to trigger the camera 40 are again activated to take another, sound disguised photograph whilst the lamps 18, 20 continue to illuminate the subject.

Figure 4:
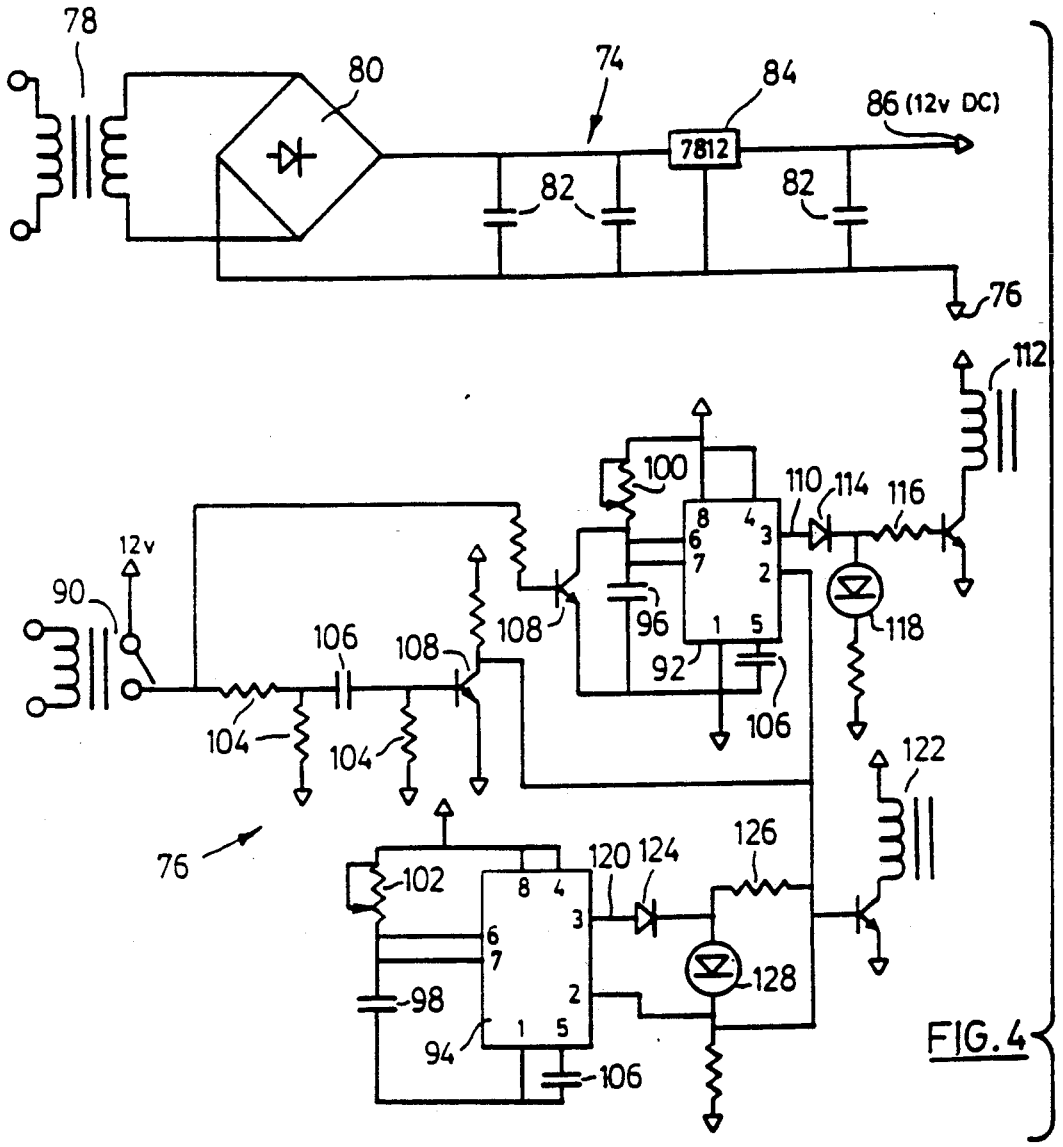
FIG. 4 is a circuit diagram of the main logic board component of the system.

The logic board 66 includes electrical circuitry as shown diagrammatically in FIG. 4. The upper portion generally designated 74 as illustrated, is the power circuit which is connected to a 110v main electrical supply and provides a 12v DC output therefrom. The lower portion deterrent designated 76 is the logic circuit proper, including two 555 microchip timers, and is fed from the 12v DC output of the power circuit.

Thus, the power circuit 74 includes transformer 78 connected to mains, outputting 12v, and feeding a bridge rectifier 80 from which a DC 12v output is obtained. On the output side of the rectifier, appropriate smoothing condensers 82 and a 7812 twelve volt positive regulator 84 are provided, so as to produce an appropriate 12v DC output terminal 86 and common terminal 88 for use by the lower logic circuit 76.

The logic circuit 76 has a relay 90 which is caused to actuate and close by a signal received from the IR sensor 10, thereby supplying the 12v DC power to the circuit. The logic circuit then powers a first 555 microchip timer 92 and a second 555 microchip timer 94, each provided with associate components in a standard configuration for a timer application, in accordance with the manufacturers recommendations. Thus, each timer 92, 94 has an associated condenser 96, 98 and an associated variable resistor 100, 102, respectively, which in combination can be arranged to set the duration of operation of the respective microchip. In practice of the illustrated embodiment, the capacitance of condenser 96 is one hundred times that of condenser 98, so that timer 92 can have a duration of operation much longer than that of timer 94, e.g. five minutes versus one half second. Resistors 104, condensers 106 and transistors 108 of standard form and appropriate values are also included.

The output 110 from microchip timer 92 is arranged to close a relay 112 to operate the lights 18, 20 and the sound generator 68 for approximately five minutes. This output is fed to the relay through a diode 114 and resistor 116. The output 110 also serves to illuminate an LED 118 to give a visual indication that a signal from sensor 10 has been received and processed to the lights and the sound generator.

The output 120 from microchip timer 94 closes a relay 122 to energize the solenoid 60 and depress its plunger 62 so as to trigger the camera. This output from microchip timer 94 lasts approximately 0.5 seconds, to ensure suitable time exposure for the photographic film, and is arranged to occur fractionally later than the output 110 from microchip timer 92. It is similarly provided to the relay 122 by way of a diode 124 and a resistor 126. The output 120 similarly illuminates an LED 128 indicating visually that a signal has been received from sensor 10 and processed to the solenoid to operate the camera.

Thus the camera operation, including the initial click of the shutter, the faint buzz of operation, the second click of the closing of the shutter, and the whir of automatic wind-on or rewind all take place during the operation of the sound generator 68 so as to be masked. This, together with the sudden illumination of the intruder by lamps 18, 20 is sufficient to create enough surprise and confusion to conceal the fact that a camera is present and has been operated.

Various additional, optional features can be added to the arrangement shown and illustrated. Thus, an additional relay to be actuated from the power circuit 74 can be added, with appropriate circuitry, to operate the operate telephone dialler 70 on receiving input from sensor 10. Similarly, other features such as outside flood lights, sound recorders, remote alarms to police stations etc. can similarly be added, for similar activation. It may also be advantageous to incorporate in the circuitry an audio or visual signal to indicate dead batteries, and to indicate arming ready for operation.

In a further modification of the device according to the invention, the output utilized to operate the solenoid to trigger the camera can also be used to power an ultrasonic generator, whereby an ultrasonic beam is emitted which is trained on an additional still camera to trigger it. This additional camera can be mounted at a different location but focused on the same general area as the first camera, so that a second picture of the illuminated intruder is obtained simultaneously, but from a different angle. The second camera's operation is similarly masked by the light and sound generation associated with the first camera, and is also suitably disguised visually, so that it is not readily recognizable as a still camera. Then, even if by some remote chance the intruder recognizes and disables the first camera, a picture is still available from the second camera. Normally, however, such a plural camera system provides a plurality of pictures of the intruder, for even better identification and detection.

Instead of providing arrangements in the housing 30 shown in FIGS. 1 and 2 to accommodate a variety of cameras, it is possible to provide a unit in which the camera is built in and permanently attached by the manufacturer. Access needs to be provided to the camera for focusing, film loading and film removal, of course, but otherwise it can be provided in a sealed unit, even using disposable cameras if desired.

We claim:

1. Intrusion detection apparatus adapted to detect the movement of a body in a space, comprising:

a sensor adapted to sense a body in the space;

light means adapted to illuminate the body in response to the sensing thereof by the sensor;

a photographic still camera adapted to be triggered to photograph the body during its illumination by the light means;

and a sound generator adapted to be actuated by the sensor to emit sound which disguises or overrides the sound of the camera operation.

2. Intrusion detection means according to claim 1, wherein the sensor is an infrared sensor.

3. Intrusion detection means according to claim 2, further including an electronic logic board controlling the operation of the camera, light means and sound generator in response to signals received from the infrared sensor.

4. Intrusion detection means according to claim 3, wherein the logic board is set to control the sequence of operations such that the camera is triggered during operation of the light means and the sound generator.

5. Intrusion detection means according to claim 4, including a solenoid and associated plunger positioned to trigger the camera on energising the solenoid, the energising of the solenoid being under the control of the logic board.

6. Intrusion detection means according to claim 5, including a battery pack to power the light means, the sound generator and the sensor under control of the logic board.

7. Intrusion detection means according to claim 6, wherein the battery pack is rechargeable.

8. Intrusion detection device according to claim 7, further including a mains operated trickle charger, adapted to maintain the battery pack in charged condition.

9. Intrusion detection means according to claim 8, further including a visual indicator to indicate a prior operation of the camera.

10. Intrusion detection means according to claim 9, wherein the visual indicator is a light emitting diode connected to the logic board.

11. Intrusion detection means according to claim 1, further including an automatic telephone dialler actuated by the sensor to dial a predetermined telephone number.

12. Intrusion detection means according to claim 1, further including an enclosure for the camera constituting a visual disguise therefor.

13. Intrusion detection means according to claim 1, wherein the camera includes data and time recording facilities, to produce on the photograph a record of the time and date on which a given photograph was taken.

* * * * *